US005518170A

United States Patent [19]

Rasmussen

[11] Patent Number: 5,518,170

[45] Date of Patent: May 21, 1996

[54] COLLAPSIBLE STORAGE PEN

[75] Inventor: Scott E. Rasmussen, West Beno, Wis.

[73] Assignee: Box Boy Ltd., Los Angeles, Calif.

[21] Appl. No.: 144,736

[22] Filed: Oct. 29, 1993

[51] Int. Cl.[6] ..... B65D 5/492

[52] U.S. Cl. ..... 229/120.26; 229/120.29; 229/120.31

[58] Field of Search ..... 229/120.26, 120.29, 229/120.31, 120.37; 224/42.42

[56] References Cited

U.S. PATENT DOCUMENTS

| | | | |
|---|---|---|---|
| 901,858 | 10/1908 | Williams . | |
| 1,823,324 | 9/1931 | Huber . | |
| 1,999,909 | 4/1935 | Lupton | 229/120.26 |
| 2,172,896 | 9/1939 | Walker | 229/120.29 |
| 2,344,567 | 3/1944 | Sidebotham . | |
| 2,391,230 | 12/1945 | Dickerman | 229/120.31 |
| 2,485,028 | 10/1949 | Bauernfreund et al. . | |
| 2,682,964 | 7/1954 | Toadvine . | |
| 2,705,588 | 4/1955 | Huckstep . | |
| 2,765,971 | 10/1956 | Golob . | |
| 2,782,951 | 2/1957 | Inman | 229/120.31 |
| 2,871,569 | 3/1957 | Wharton, Jr. . | |
| 3,003,680 | 10/1961 | Wilcox, Jr. . | |
| 3,039,667 | 6/1962 | Kozlik . | |
| 3,107,649 | 10/1963 | Blend, Jr. . | |
| 3,139,229 | 6/1964 | De Pasquale . | |
| 3,380,642 | 4/1968 | Kotowick | 229/120.29 |
| 3,403,835 | 10/1968 | Schwaner . | |
| 3,640,455 | 2/1972 | Durham . | |
| 3,843,039 | 10/1974 | Brown et al. . | |
| 3,871,569 | 3/1975 | Wharton, Jr. . | |
| 3,880,343 | 4/1975 | Rockefeller . | |
| 3,986,655 | 10/1976 | November . | |
| 3,997,102 | 12/1976 | Jones . | |
| 4,108,349 | 8/1978 | Pfaffendorf | 229/120.26 |
| 4,124,158 | 11/1978 | Beck . | |
| 4,226,348 | 10/1980 | Dottor et al. . | |
| 4,280,650 | 7/1981 | Gardner et al. . | |
| 4,351,471 | 9/1982 | Dunkle | 229/120.37 |
| 4,372,512 | 2/1983 | Wolfe . | |
| 4,534,504 | 8/1985 | Locke . | |
| 4,540,213 | 9/1985 | Herlitz et al. . | |
| 4,718,584 | 1/1988 | Schoeny . | |
| 4,750,773 | 6/1988 | Chapline et al. . | |
| 4,951,867 | 8/1990 | McManus . | |
| 5,004,146 | 4/1991 | Thominet et al. . | |
| 5,052,580 | 10/1991 | Khoury . | |
| 5,054,668 | 10/1991 | Ricchiuti . | |
| 5,167,363 | 12/1992 | Adkinson et al. . | |
| 5,230,690 | 7/1993 | Adkinson et al. . | |

FOREIGN PATENT DOCUMENTS

| | | | |
|---|---|---|---|
| 5077826 | 3/1993 | Japan | 229/120.29 |

*Primary Examiner*—Gary E. Elkins
*Attorney, Agent, or Firm*—Cumpston & Shaw

[57] ABSTRACT

A collapsible storage pen is disclosed. The pen having a segmented peripheral wall and interior wall segments forming a plurality of retaining cells, the interior wall segments being connected to the peripheral wall to move between an open position defining a rectangular periphery and a closed position wherein the wall segments are parallel and the length of the collapsed pen is less than the length of the longest side of the open pen. A method of forming the segmented peripheral wall and interior walls from a single blank of material is also disclosed.

18 Claims, 10 Drawing Sheets

COLLAPSIBLE STORAGE PEN

BACKGROUND OF THE INVENTION

This application relates to collapsible storage pens, and more particularly to an improved collapsible storage pen that can be formed from a single die of material, assembled easily and collapsed to an even more compact configuration than known pens.

Collapsible storage pens have become increasingly important for supporting flexible packages such as grocery bags and the like in moving vehicles to prevent the packages from tipping over and spilling the contents thereof within the vehicle. A known collapsible storage pen of the like with which this invention is concerned is shown in U.S. Pat. Nos. 5,230,690, and 5,167,363. The collapsible storage pens shown in the patents mentioned above are relatively compact, and some can be formed from a single die and all are collapsible to a relatively compact configuration.

Nevertheless, there is a need for a storage pen that can be collapsed to a dimension smaller than the dimension in the operative or open position. The need exists for a collapsible storage pen that can form one, two, three or four retaining cells. A further need exists for a storage pen that can be fabricated using automatic machinery in a relatively simple operation, and one that is durable and provides for a long life when in use. The need also exists for a storage pen that may be formed of a variety of materials. In addition, the need exists for a pen that can be readily opened with one hand, and remain in the operative position without requiring extensive secondary operations.

SUMMARY OF THE INVENTION

In accordance with a preferred embodiment of the present invention, a collapsible storage pen includes an articulated peripheral wall having a plurality of wall segments; and first and second interior walls connected to the peripheral wall and pivotal about a substantially common axis from a first parallel position wherein a portion of the peripheral wall is intermediate of the interior walls to a second parallel position wherein the first and second interior walls are substantially enclosed by the peripheral wall. The present design permits the storage pen to assume a collapsed length that is less than the length of the open pen. Further, the present storage pen may be readily opened and closed with one hand.

DETAILED DESCRIPTION OF THE PREFERRED EMBODIMENTS

Figure 1:
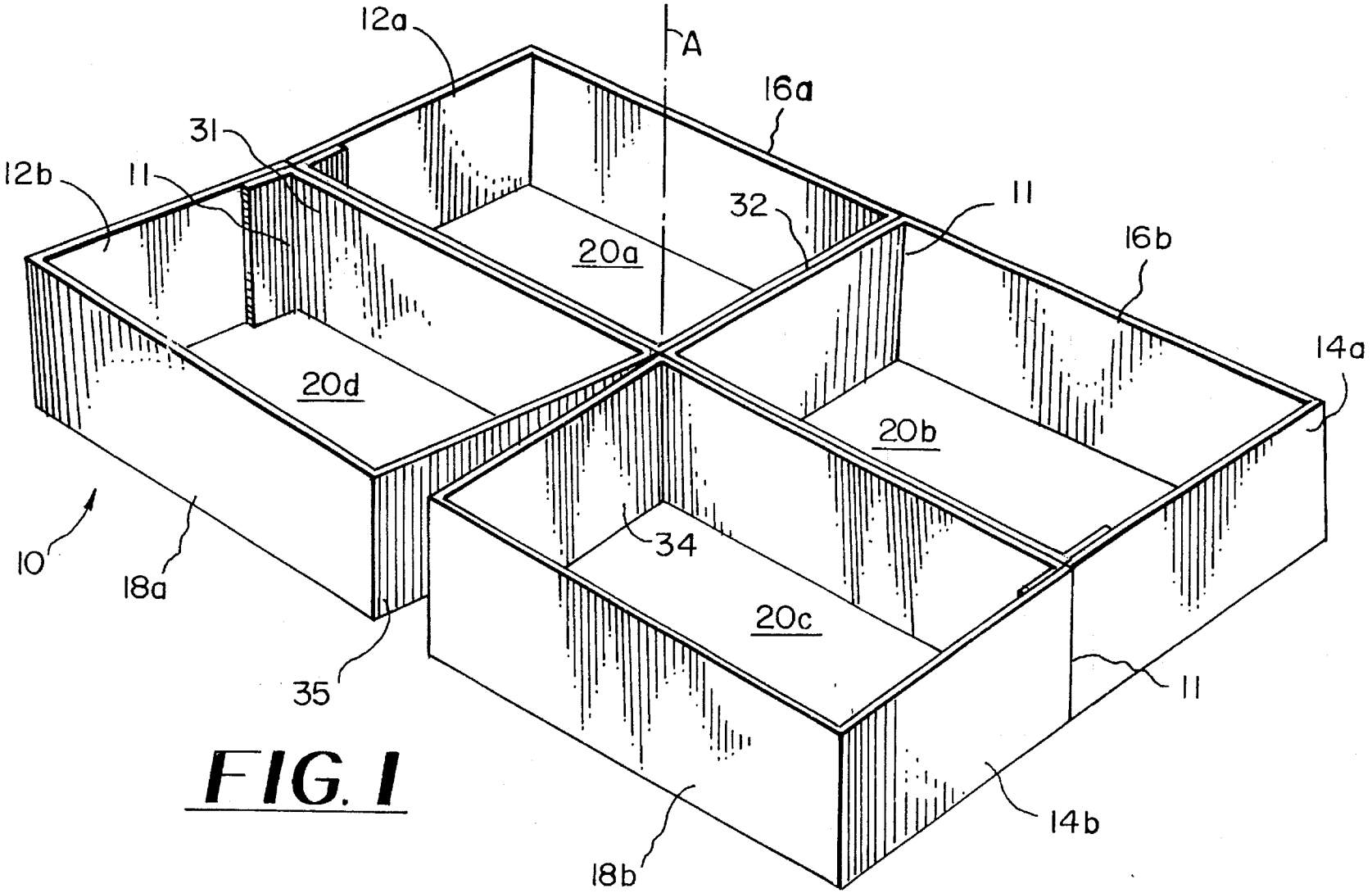
FIG. 1 is a perspective view of the collapsible storage pen of the present invention in the open position.

Referring now to FIG. 1, a collapsible storage pen 10 in accordance with this invention is illustrated in its assembled, open configuration. The pen 10 includes a plurality of retaining cells 20*a*, 20*b*, 20*c* and 20*d* which when in the open position take the form of rectangles and which are collapsible through a parallelogram configuration to a closed substantially flat or parallel position for storage.

In a preferred embodiment, the open storage pen 10 has a peripheral wall or exterior wall segments including a pair of parallel end walls 12,14 connected by a pair of parallel side walls 16,18. Each end wall 12, 14 and side wall 16 includes an intermediate bend line 11 to form segments of each end wall 12*a*, 12*b*, 14*a*, 14*b* and side wall 16*a*, 16*b*. Although the bend lines 11 are shown as bisecting the respective wall, the bend lines may be located at other positions. Side wall 18 includes segments 18*a* and 18*b*, wherein segment 18*a*is directly connected to segment 12*b* and segment 18*b* is directly connected to 14*b*.

Figure 9:
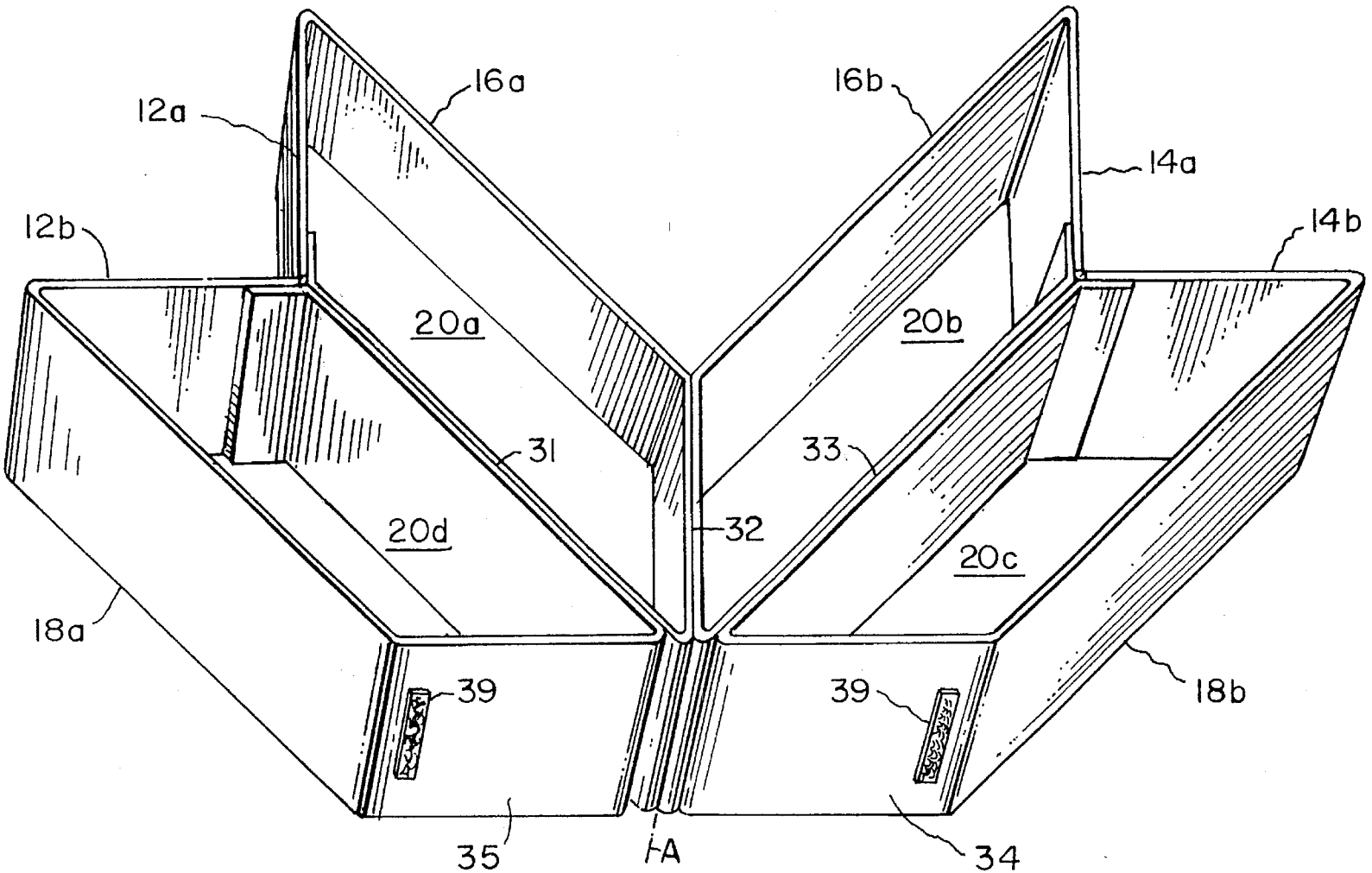
FIG. 9 is a perspective view showing the storage pen as shown in FIG. 5.
Figure 10:
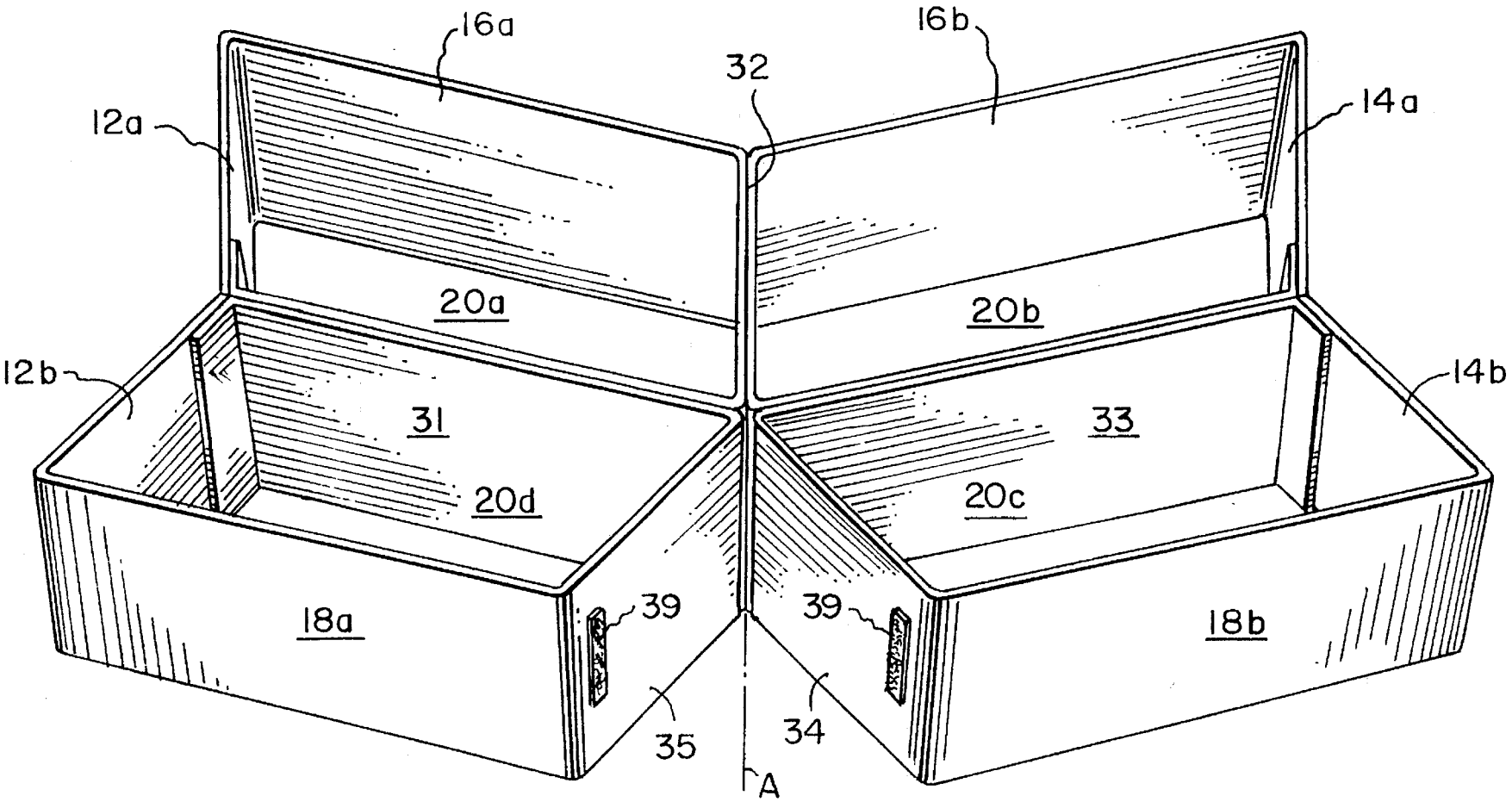
FIG. 10 is a perspective view showing the storage pen as shown in FIG. 6.

As shown in FIGS. 1 and 9–10, there are five interior wall segments 31–35, wherein each wall segment includes an inner end which intersects a common axis A within the periphery of the peripheral wall in the open position. An outer end of each of the interior wall segments 31–35 is connected to the peripheral wall. The interior wall segments are interconnected to the peripheral wall segments so as to be surrounded by the peripheral wall segments in the open position.

Specifically, the outer end of the interior wall segment 31 is connected to the peripheral wall at the bend line 11 between segments 12*a* and 12*b*. The outer end of the interior wall segment 32 is connected to the peripheral wall at the bend line 11 between segments 16*a* and 16*b*. The outer end of the interior wall segment 33 is connected to the peripheral wall at the bend line 11 between segments 14*a* and 14*b*. In the open configuration, two interior wall segments 34 and 35 extend from the common axis A to be substantially adjacent and parallel to each other to connect to individual peripheral wall segments 18*b*, 18*a*, respectively. As the two adjacent interior wall segments 34, 35 abut each other in the open configuration of the pen, the respective peripheral wall segments 18*b*, 18*a* also abut so that the peripheral wall segments 12, 14, 16 and 18 form a substantially continuous periphery. Therefore, each retaining cell 20*a*, 20*b*, 20*c* and 20*d* is defined by a pair of interior wall segments and a pair of exterior wall segments, wherein each retaining cell 20*a*, 20*b*, 20*c* and 20*d* includes an interior wall segment which intersects the common axis A.

The outer surface of the interior walls 34, 35 may include complementary fastening devices 39 such as hook and loop fasteners, releasable adhesives or snap engagements. Alternatively, one of the interior wall segments 34, 35 may include a cutout and the remaining wall segment include a corresponding flap for being disposed within the cutout to retain the interior wall segments in a substantially parallel adjacent position in the open configuration of the pen 10.

In the preferred embodiment, wall segments 12*a*, 12*b*, 14*a*, 14*b*, 32, 34 and 35 have substantially equal lengths and wall segments 16*a*, 16*b*, 18*a*, 18*b*, 31 and 33 have substantially equal lengths. Although interior wall segments 34 and 35 are shown as the separable interior wall segments extending from the common axis A and connecting to the side wall 18, these interior wall segments may extend from the common axis A toward either side wall or end wall of the pen 10. That is, the separable interior wall segments may be oriented to separate either end wall 12 or 14, or either side wall 16 or 18, so that the respective end wall or side wall is configured as shown in FIG. 1.

Figure 3:
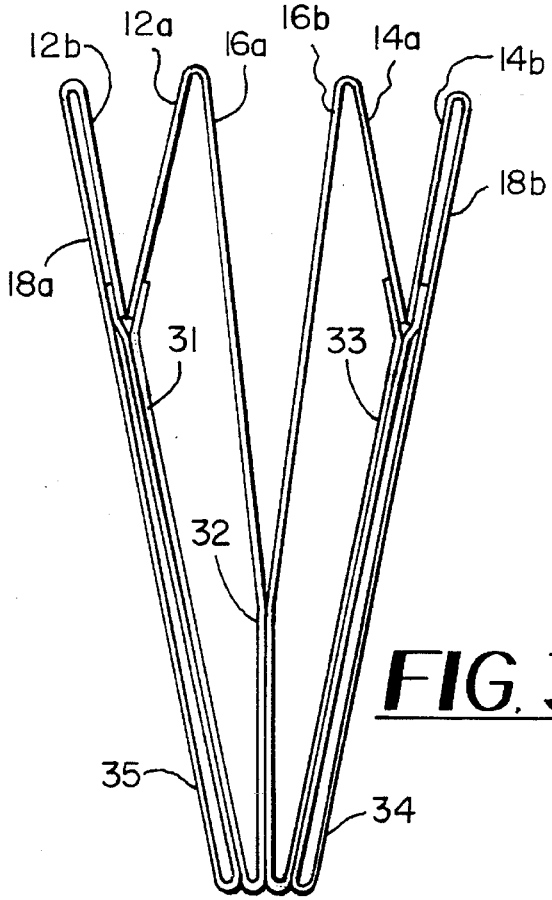
FIG. 3 is a top plan view of the storage pen being opened from the collapsed position.
Figure 4:
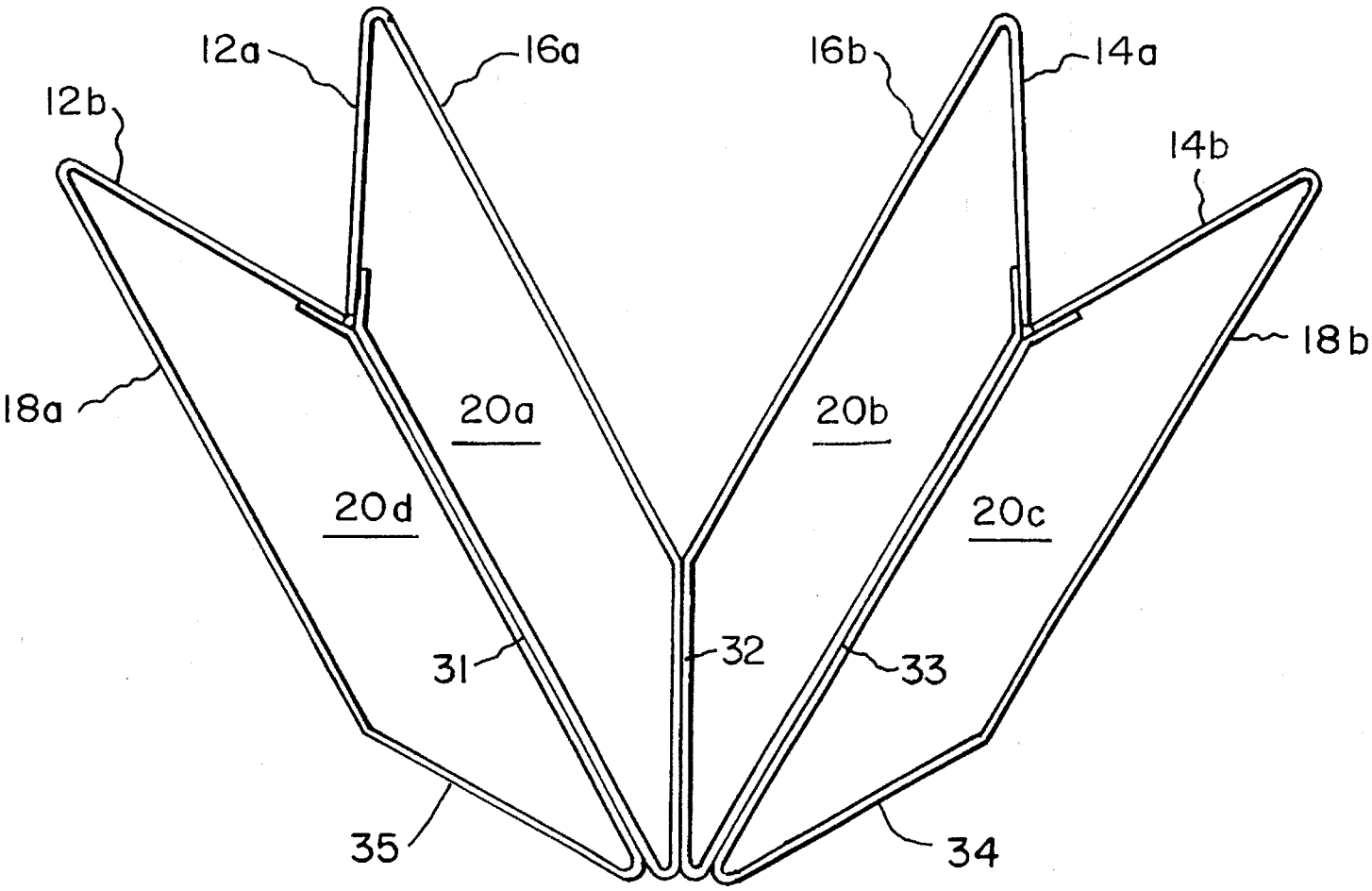
FIG. 4 is a top plan view of a further opening of the storage pen.
Figure 5:
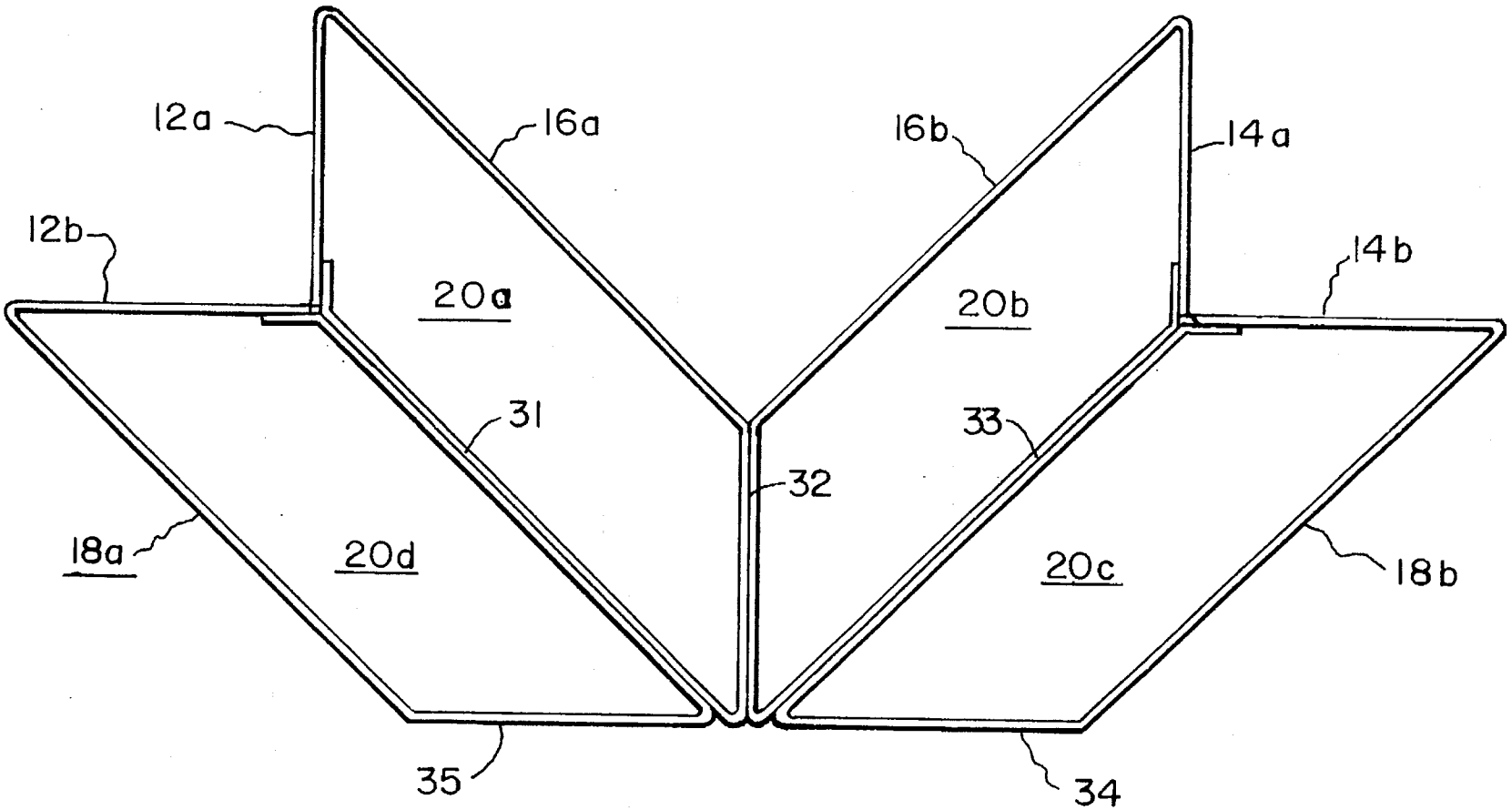
FIG. 5 is a top plan view of a further opening of the storage pen.
Figure 6:
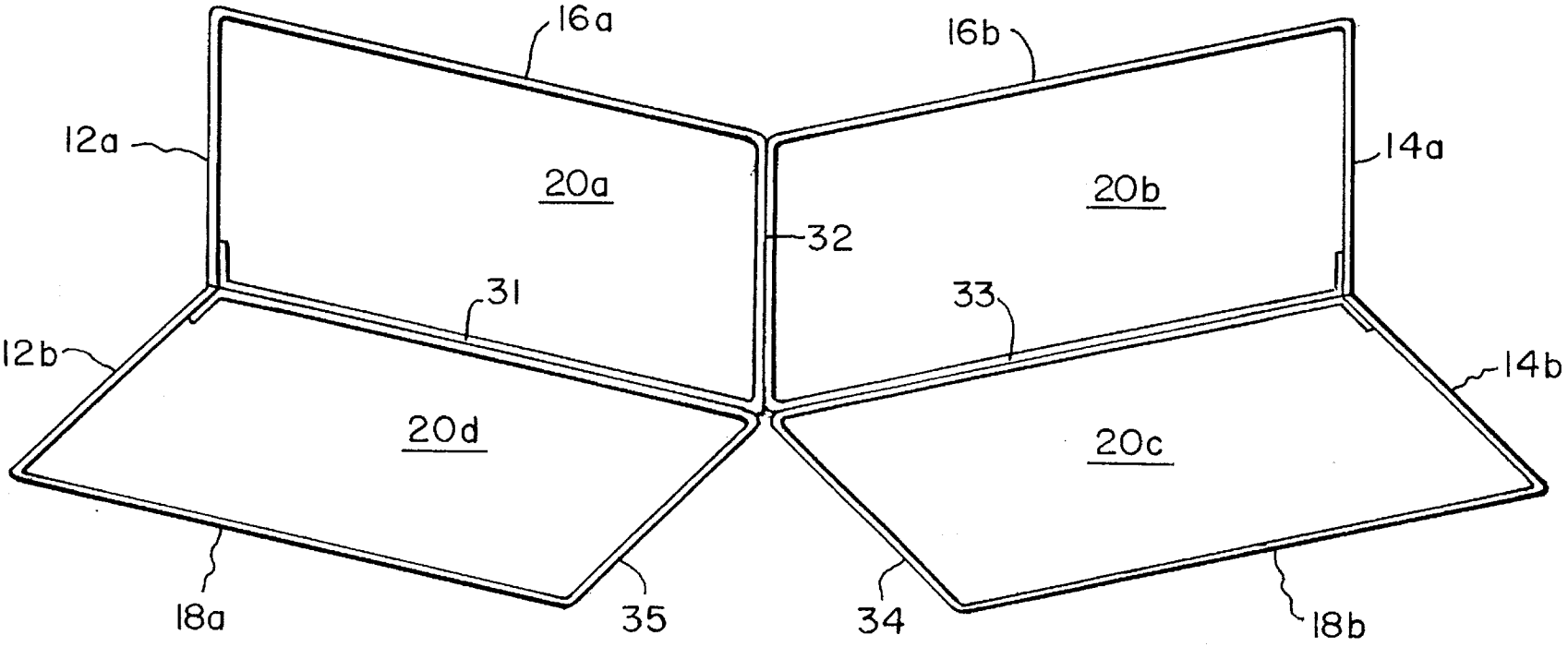
FIG. 6 is a top plan view of a further opening of the storage pen.
Figure 7:
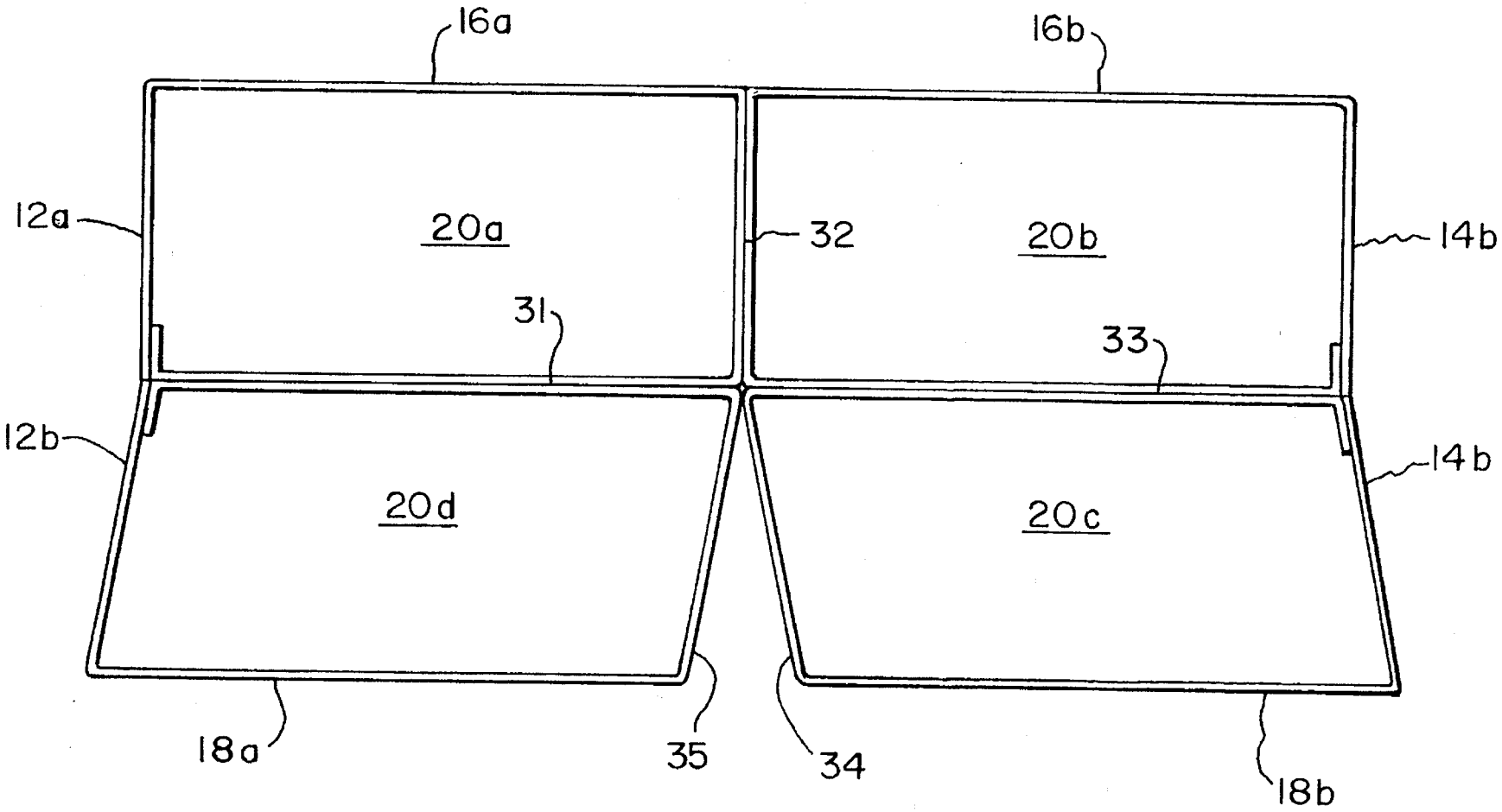
FIG. 7 is a top plan view of a substantial opening of the storage pen.
Figure 8:
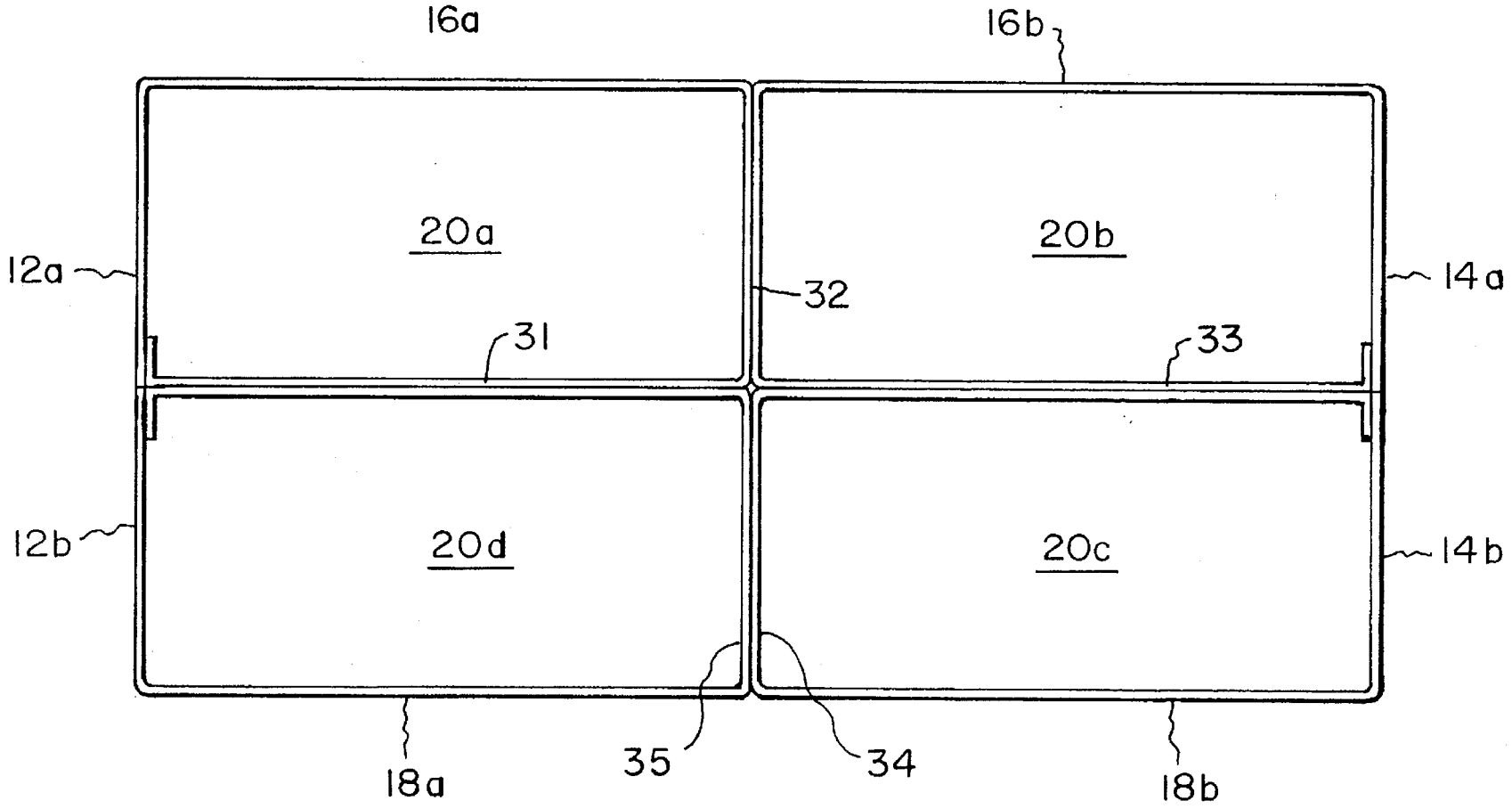
FIG. 8 is a top plan view of the storage pen in an open position.

Referring to FIGS. 1 and 3, adjacent end wall and side wall segments are connected by a fold line permitting orientation of the segments in a perpendicular or parallel orientation as dictated by the specific location of the fold line.

As shown in FIGS. 1–10 and most particularly FIGS. 1 and 9–10, retaining cell 20 a is formed by peripheral wall segments 12*a*, 16*a* and interior wall segments 31 and 32. Retaining cell 20*b* is formed of peripheral wall segments 16*b*, 14*a* and interior wall segments 32 and 33. Retaining cell 20*c* is formed by peripheral wall segments 14*b*, 18*b* and interior wall segments 33 and 34, while retaining cell 20*d* is formed by peripheral wall segments 18*a*, 12*b* and interior wall segments 31 and 35. As shown FIGS. 1–10 interior wall segments 31, 32 and 33 are common to more than one retaining cell, wherein interior wall segments 34 and 35 are exclusive to retaining cells 20*c* and 20*d*respectively. The pen 10 therefore includes two retaining cells 20*a* and 20*b*which are defined by only shared interior wall segments 31, 32 and 33, while two retaining cells 20*c* and 20*d* are defined in part by non shared or exclusive interior wall segments 34, 35. The interior wall segments 34, 35 effectively form an exterior wall prior to positioning the pen 10 in the fully open position.

Operation

To collapse the storage pen 10, the fastener connecting the two separable interior walls 34, 35 is disconnected. The two retaining cells 20*c*, 20*d* at least partially defined by the two interior wall segments 34, 35, respectively begin to collapse as the interior wall segments 34, 35 rotate about the common axis A. Rotation continues until the interior wall segments 31 and 33 also rotate about the common axis A. Rotation of the interior wall segments 31, 33, 34 and 35 continues about the common axis A until all the interior wall segments are substantially parallel as shown in FIG. 2.

In the collapsed position, the length of the storage pen is defined by one half the total length of the side wall 16 or 18 (side wall segment 16*a*, or 16*b*, 18 or 18*b*) and one half the length of an end wall 12 or 14 (wall segment 12*a*, 12*b*, 14*a* or 14*b*). As the end wall segments 12*a*, 12*b*, 14*a* or 14*b* are shorter than the side wall segments 16*a*, 16*b*, 18*a* or 18*b*, the collapsed length of the storage pen 10 is less than the length of an entire side wall 16 or 18 in the open position. As the interior wall segments 32, 34 and 35 are the same length as the end wall segments 12*a*, 12*b*, 14*a* or 14*b*, and interior wall segments 31 and 33 are the same length as wall segments 16*a*, 16*b*, 18*a* or 18*b*, the relative length of the pen in the collapsed or open position may be described in terms of the length of the interior wall segments or the peripheral wall segments.

Figure 2:
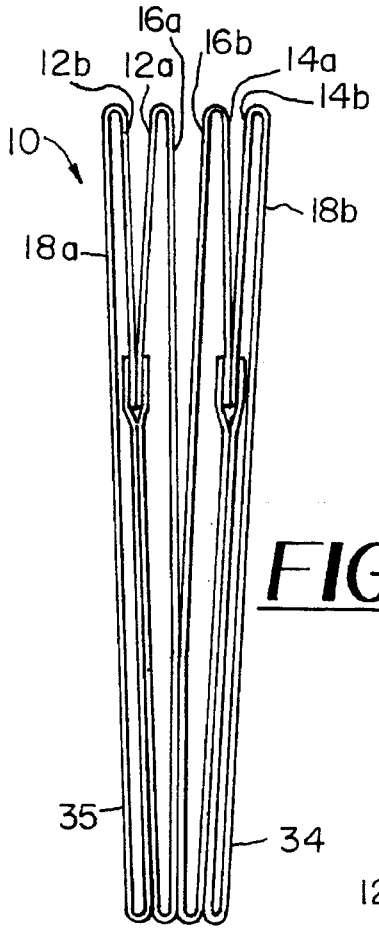
FIG. 2 is a top plan view of the storage pen in its substantially collapsed position.

Referring to FIGS. 2 and 3, in the collapsed position of the pen 10 a portion of the side wall segments 16*a* and 16*b* are intermediate of a portion of the two interior wall segments 31 and 33. In the collapsed position of the pen 10, all the peripheral wall segments are intermediate of the planes defined by peripheral segment 18*a* and interior wall segment 35, and peripheral wall segment 18*b* and interior wall segment 34. That is, a portion of the peripheral walls 12, 14, 16 and 18 is intermediate of a portion of the interior wall segments in the collapsed position of the pen 10.

To configure the storage pen 10 from the collapsed position to the open position, the separable interior wall segments 34, 35 are rotated about the common axis A so as to cause the retaining cells 20*a*, 20*b*, 20*c* and 20*d* to form substantially parallelogram configurations. Rotation continues until the retaining cells 20*a*, 20*b*, 20*c* and 20*d* assume a substantially rectangular orientation in the open position. A complementary fastening device 39 may retain the interior wall segments 34, 35 parallel and adjacent to each other to form the storage pen 10 as shown in FIG. 1.

It is presently believed that upon formation of the present invention in a curable or setable plastic material, the fastening mechanism for retaining the separable interior walls 34, 35 in the open position may be obviated. However, due to the resiliency, elasticity and memory of cardboard, upon formation of the storage pen in cardboard, the fastening mechanism may be warranted.

The storage pen 10 may be folded or open/closed to form one, two, three or four retaining cells, as dictated by available space. Specifically, in moving from the collapsed position as shown in FIG. 2, retaining cell 20*a*may be opened while the remaining cells are collapsed to form the single retaining cell storage pen. If desired, retaining cell 20*b* may also be opened to form the second retaining cell of a two retaining cell configuration of the storage pen. Similarly, retaining cell 20*c* may be opened to form a three retaining cell storage pen, and finally retaining cell 20*d* may be opened to form the configuration as shown in FIGS. 1 and 10.

The storage pen 10 is especially adapted to be formed from a single blank of flexible material, such as cardboard, that can be die cut in as few as one process steps mad subsequently folded and attached, preferably glued in an easily automated operation to form the collapsible storage pen. Alternatively, the storage pen or wall segments may be formed by molding a plastic material to parallel the present construction, or form the wall segments as in the finished product.

Figure 11:
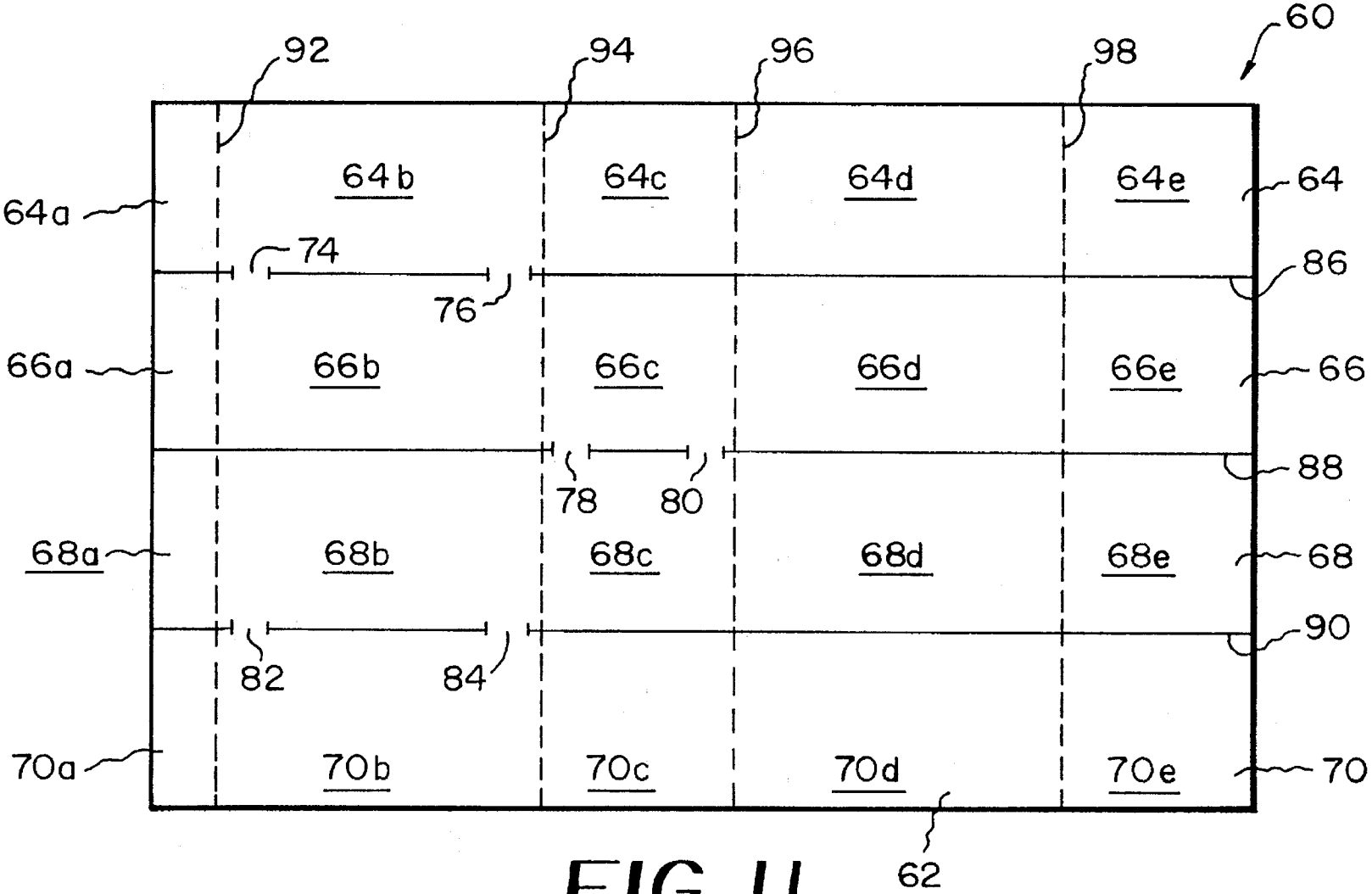
FIG. 11 is a top plan view of a die cut blank for forming the present invention.

Referring now to FIG. 11, a die cut 60 blank for forming a collapsible storage pen in accordance with this invention is illustrated in a top plan view. The blank is formed from a generally rectangular sheet 62 of flexible material, such as cardboard or plastic. The blank includes four elongated flexible webs of material 64, 66, 68, 70. Each web is divided into five sections by fold lines, creases or other lines of weakness along which the flexible material may be bent. Each web includes a first glue tab 64*a*, 66*a*, 68*a*, 70*a*, a first side wall section 64*b*, 66*b*, 68*b*, 70*b*, a second end wall section 64*c*, 66*c*, 68*c*, 70*c*, a third side wall section 64*d*, 66*d*, 68*d*, 70*d*, and a fourth end wall section 64*e*, 66*e*, 68*e*, 70*e*. Each web is joined to an adjacent web by a hinge formed at adjacent edges of one section of the elongated web, and its adjacent web. Specifically, the web 64 forming the first section of the pen is joined to the web 66 forming the second section of the pen by hinge sections 74, 76 joining the first elongated side portions of the webs. The second web 66 is joined to the third web 68 by hinge sections 78, 80 connecting the adjacent edges of the end sections of the webs and the third web 68 is joined to the fourth web 70 by hinge sections 82, 84 connecting adjacent side portions of the web.

Except for the hinge sections, all of the individual webs are separated from the adjacent webs by die cut lines of separation 86, 88 and 90.

To form the collapsible storage pen from the blank shown in FIGS. 1–10, the following steps are performed, not necessarily in the order mentioned. The blank 60 is folded along the line 88 separating the second and third webs, so that the facing surfaces 66*c*, 68*c* of the second and third webs are brought into proximity. An adhesive layer is applied to one or both of the surfaces of the end wall sections connected by the second hinge, and these end wall sections, but not the remainder of the webs, are permanently attached together. The first and second webs are then folded to bring the facing surfaces of the side wall panels 64*b*, 66*b* connected by the hinge 74, 76 into face to face alignment, and a layer of adhesive is applied to one or both of the surfaces to permanently connect the surfaces, but not the remaining sections of the first and second webs together.

Similarly, the third and fourth webs 68, 70 are connected by applying adhesive to the connected elongated side panels, which are folded at the hinge lines and brought into permanent attachment, bound by the adhesive layer.

Finally, each of the webs is formed into a complete pen by folding the webs along the dotted lines of perforation 92, 94, 96, 98 and attaching the ends of each web to the opposite ends by providing an adhesive layer on the glue tabs 64*a*, 66*a*, 68*a*, 70*a*. After each of the four compartments has been formed, a configuration similar to that shown in FIG. 1 is produced. The collapsible pen may then be collapsed as already described to its most compact configuration.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A bottomless collapsible storage pen moveable between a collapsed position and an open position, comprising:

(a) an articulated peripheral wall having a plurality of wall segments; and (b) first and second interior walls hingedly connected at an outer end to the peripheral wall to form at least two retaining cells, wherein a single blank of material forms the wall segments and the first and the second interior walls, the first and the second interior walls being substantially pivotal about corresponding inner ends from a first parallel position wherein a portion of the peripheral wall is between the interior walls to a second parallel position wherein the first and second interior walls are substantially enclosed by the peripheral wall.

2. The bottomless collapsible storage pen of claim 1, wherein at least one of the first and second interior walls rotates about the corresponding inner end through at least approximately 180 degrees from the collapsed position to the open position.

3. The bottomless collapsible storage pen of claim 1, wherein the pen in the collapsed position defines a collapsed length and the pen in the open position defines a rectangular periphery having two end walls and two perpendicular longer side walls, and the collapsed length is less than the length of one of the side walls.

4. The bottomless collapsible storage pen of claim 3, wherein the collapsed length is substantially equal to one half the end wall and half the side wall.

5. The bottomless collapsible storage pen of claim 1, wherein the peripheral wall and the first and second interior walls are plastic.

6. The bottomless collapsible storage pen of claim 1, wherein the first and second interior walls are adjacent in the open position.

7. A bottomless collapsible storage pen moveable between a collapsed position and an open position to define a plurality of retaining cells, comprising:

(a) a peripheral wall having a plurality of peripheral wall segments;

(b) a plurality of interior wall segments having an outer end pivotally connected to the peripheral wall to form a portion of the retaining cells, wherein at least two of the retaining cells are defined by a contiguous body of material, inner ends of the interior walls intersecting a substantially common axis in the collapsed position for rotation of all but one interior wall segment by at least 90 degrees about the common axis in moving between the collapsed position and the open position.

8. A bottomless collapsible storage pen moveable between a collapsed position defining a collapsed length and an open position, the open position defining a plurality of retaining cells, comprising:

(a) a peripheral wall having a plurality of peripheral wall segments defining a pair of side walls and a pair of shorter end walls, wherein adjacent peripheral wall segments are pivotally connected; and (b) a plurality of interior wall segments having outer ends pivotally connected to the peripheral wall to form the plurality of retaining cells, wherein at least two of the retaining cells are portions of a contiguous piece of material; the interior wall segments and the peripheral wall segments being connected so that the collapsed length is less than the length of one of the side walls in the open position.

9. A bottomless collapsible storage pen moveable between a collapsed position and an open position, comprising:

(a) a plurality of retaining cells defined by interconnected articulated wall segments to define a plurality of parallelograms wherein at least two of the parallelograms are formed of an integral piece of material, the parallelograms defined by peripheral wall segments and hingedly connected interior wall segments, the interior wall segments terminating at a substantially common end wherein the interior wall segments rotate about the common end in movement from the collapsed position to the open position, the common end lying at one end of the storage pen in the collapsed position and within a periphery of the storage pen in the open position.

10. The bottomless collapsible storage pen of claim 9, wherein at least two of the articulated wall segments rotate about the common end to move from the collapsed position to the open position.

11. A collapsible storage pen comprising:

(a) first, second, third and fourth generally rectangular compartments, each compartment including four articulated wall segments each wall segment having an upper edge and a lower edge, and two of the wall segments in each compartment are interior wall segments and only two of the wall segments are exterior wall segments;

(b) a first hinge joining a first compartment wall segment to a first wall segment of the second compartment along a lower edge of each wall segment;

(c) a second hinge joining a second wall segment of the second compartment to a first wall segment of the third compartment along an upper edge of each wall segment; and (d) a third hinge joining a second wall segment of the third compartment to a first wall segment of the fourth compartment along a lower edge of each wall segment.

12. The collapsible storage pen of claim 11, in which each of the compartments comprises a continuous web of flexible material having first and second ends attached together at a corner.

13. The collapsible storage pen of claim 11, further comprising a first bond between the wall segment of the first compartment and the wall segment of the second compartment that are joined by the first hinge; a second bond between the wall segment of the second compartment and the wall segment of the third compartment that are joined by the second hinge; and a third bond between the wall segment of the third compartment and the wall segment of the fourth compartment that are joined by the third hinge.

14. The collapsible storage pen of claim 11 in which all of the articulated wall segments of all of the compartments are formed from a single web of flexible material.

15. A bottomless collapsible storage pen moveable between a collapsed position defining a collapsed length and an open position defining an open length, comprising:

(a) a peripheral wall having a plurality of peripheral wall segments defining a pair of side walls and a pair of shorter end walls; and (b) a plurality of interior wall segments connected to the peripheral wall to form a plurality of retaining cells;

wherein the peripheral wall and the interior wall segments are formed of a contiguous piece of material, the interior wall segments and the peripheral wall segments being connected so that the collapsed length is less than the open length.

16. A collapsible storage pen, comprising:

(a) an articulated peripheral wall comprising a plurality of peripheral wall segments;

(b) a plurality of interior wall segments, each interior wall segment having one edge connected to an edge of a peripheral wall segment and another edge lying adjacent a common axis; all but two of the interior wall segments being attached in face to face relationship to an adjacent interior wall segment, the interior walls being rotatable about the common axis from a first position in which the interior and peripheral wall segments lie substantially parallel to each other, and a second position in which the interior wall segments are substantially enclosed by the peripheral wall segments to form a plurality of compartments.

17. The collapsible storage pen of claim 16, wherein the peripheral wall and the interior wall segments are plastic.

18. The collapsible storage pen of claim 16, wherein the peripheral wall defines a pair of side walls and a pair of shorter end walls in the second position.

* * * * *